United States Patent [19]

Blaisdell et al.

[11] Patent Number: 4,878,159

[45] Date of Patent: Oct. 31, 1989

[54] FLUORESCENT LAMP HAVING REMOVABLE JACKET

[75] Inventors: Ronald G. Blaisdell, Saugus; Harold L. Hough, Beverly, both of Mass.

[73] Assignee: GTE Products Corporation, Danvers, Mass.

[21] Appl. No.: 255,306

[22] Filed: Oct. 11, 1988

[51] Int. Cl.[4] ..... F21S 3/00

[52] U.S. Cl. ..... 362/222; 362/216; 362/260; 362/267; 362/311; 362/363; 362/378

[58] Field of Search ..... 362/222, 216, 223, 260, 362/311, 267, 363, 353, 376, 378, 377; 313/312

[56] References Cited

U.S. PATENT DOCUMENTS

| | | | |
|---|---|---|---|
| 4,375,607 | 3/1983 | Morton et al. | 315/56 |
| 4,503,360 | 3/1985 | Bedel | 315/112 |
| 4,654,557 | 3/1987 | Haraden | 313/318 |
| 4,688,874 | 8/1987 | Bjorkmann | 439/56 |
| 4,787,018 | 11/1988 | Poyer | 362/216 |

*Primary Examiner*—Stephen F. Husar
*Attorney, Agent, or Firm*—Carlo S. Bessone

[57] ABSTRACT

A fluorescent lamp unit including an adapter which contains a ballast, a fluorescent lamp electrically coupled to the adapter, a compressible gasket member and a jacket. The jacket is adapted to be easily removed from the unit upon failure of the fluorescent lamp. An inwardly protruding ledge which extends radially around the interior of the jacket provides a bearing surface for contacting the gasket member. Preferable, the lower portion of the jacket member is provided with a pair of diametrically opposed grooves for engaging a pair of lugs formed in the housing of the adapter. Preferably, each of the grooves has an offset portion and a stop for locking the lugs in place and thereby preventing rotation of the jacket member with respect to the adapter until the gasket member is compressed.

8 Claims, 3 Drawing Sheets

FLUORESCENT LAMP HAVING REMOVABLE JACKET

FIELD OF THE INVENTION

This invention relates to electric lamps and has particular reference to an improved lamp unit of compact size that employs a convoluted fluorescent lamp as the light source and is adapted for use in residential and commercial lighting fixtures which are designed for incandescent-type lamps.

BACKGROUND OF THE INVENTION

Fluorescent lamp units that are specially constructed for use in conventional lighting fixtures having screw-type sockets are well known in the art. A lamp unit of this type having a triple-U-bend fluorescent lamp that is mounted on a base structure along with circuit means and is protected by a cover or jacket component is disclosed in U.S Pat. No. 4,270,071, which issued to Morton on May 26, 1981. The convoluted fluorescent lamp is directly wired to the circuit components or the base member of the unit. As a result, the entire unit is discarded upon failure of the fluorescent lamp or one of the circuit components.

From the standpoint of the consumer, it is very advantageous financially to be able to remove and replace only the convoluted fluorescent lamp component of the lamp unit and retain the base structure, protective jacket and circuit components as permanent parts of the light fixture in which the lamp unit is used. A lamp unit of this type is disclosed in U.S. Pat. No. 4,375,607, which issued to Morton et al on Mar. 1, 1983. The cover is releasably fastened to the lower module and can be detached and removed from the unit along with the fluorescent lamp and the ballast component. A pair of tongue-like elements mate with a slotted rim portion of the module. The convoluted fluorescent lamp includes a lamp base having pin terminals which mate with a plug-in socket which allows removal of the lamp.

U.S. Pat. No. 4,503,360, which issued to Bedel on Mar. 5, 1985, discloses another fluorescent unit in which the lamp can be removed from the unit. In the embodiment illustrated in FIG. 9, a pair of tab-like extensions 62 on opposite sides of the cover extend into the associated pair of air ducts and snap interlock with slots provided at the ends of the outer face of the ducts. In an alternative embodiment as shown in FIG. 24, air ducts are formed as integral parts of the cover and are shaped and located so that they register with the port openings in the flange of the module when these components are fitted together in assembled relationship.

U.S. Pat. No. 4,688,874, which issued to Björkman on Aug. 25, 1987, describes an adapter for a fluorescent lamp wherein attachment means 26 (in FIG. 9) are provided for the attachment of the cover to the lamp holder.

While the prior art lamp assemblies are satisfactory from the standpoint of providing a compact fluorescent lamp unit that can be used in incandescent-type lamp sockets and fixtures, the construction of the jacket, and more particularly, the means for attaching the jacket is such that it is often difficult to remove the jacket from the lamp unit. Some of the units may be unsuitable for certain fixture location because the jacket allows dirt and moisture to enter. Moreover, some of the units with detachable covers are attached to the lower portion of the unit in a manner which provides a loose fit which may permit undesirable movement of the cover.

BRIEF SUMMARY OF THE INVENTION

It is, therefore, an object of the present invention to obviate the disadvantages of the prior art.

It is still object of the invention to provide an improved fluorescent lamp unit with a jacket member which can easily be detached.

It is yet another object of the invention to provide a fluorescent lamp unit having a weather-tight seal to prevent dirt and moisture from entering the interior of the jacket member.

It is still another object of the invention to provide a fluorescent lamp unit which has a more securely attached jacket member and does not allow any undesirable lateral, side-to-side movement of the jacket member with respect to the adapter.

It is another object of the invention to provide a fluorescent lamp unit having a replaceable jacket member which rotationally locks the jacket member to the adapter.

These objects are accomplished in one aspect of the invention by the provision of a fluorescent lamp unit comprising a fluorescent lamp, an adapter, a compressible gasket member and a detachable jacket member. The adapter includes a housing having an upper surface and contains a ballast within the housing electrically coupled to the fluorescent lamp. A pair of lugs protrude from the housing of the adapter. The compressible gasket member (e.g., silicon) is located on the upper surface of the adapter. The detachable jacket member encloses the fluorescent lamp and has an inner surface and a ledge protruding inwardly from the inner surface and extending radially around the jacket member. The ledge has a bearing surface for contacting the compressible gasket member. The jacket member further includes a pair of diametrically opposed grooves formed in the inner surface of the jacket member and positioned to engage with the pair of lugs on the housing of the adapter.

In accordance with further teachings of the present invention, the jacket member includes a dome portion and a skirt portion. Preferably, the skirt portion extends over a portion of the housing of the adapter.

In accordance with further aspects of the present invention, each of the diametrically opposed grooves include stop means formed therein for locking the jacket member in place by preventing rotational movement of the jacket member with respect to the adapter. Preferably, a detent is formed in each of the grooves adjacent the offset portion of the groove.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
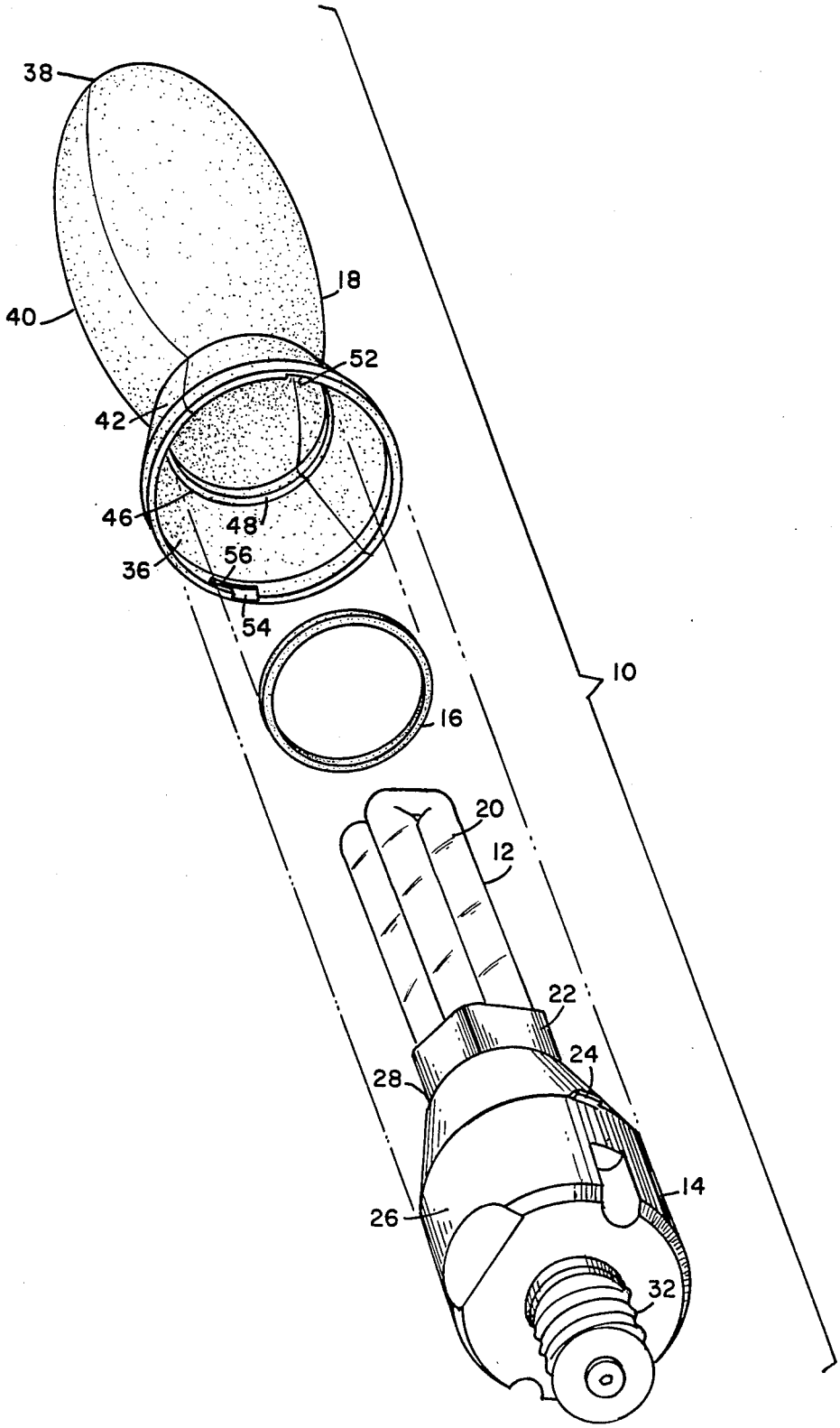
FIG. 1 represents an exploded, perspective view of the fluorescent lamp unit according to the present invention including adapter, fluorescent lamp, compressible gasket member and detachable jacket member.

Referring to the drawings and more particularly to FIG. 1 thereof, a fluorescent lamp unit 10 according to the present invention is illustrated in an exploded, perspective view, which includes a fluorescent lamp 12, an adapter 14, a compressible gasket member 16 and a detachable jacket member 18. The jacket member can easily be removed from the adapter to allow replacement of the fluorescent lamp. Moreover, a weather-tight seal is formed between the jacket member and the adapter housing to protect the lamp from dirt and moisture.

The fluorescent lamp 12 illustrated in the drawings and selected as Preferred (but not limited thereto) for use in connection with the present invention is a "Double Twin Tube" such as manufactured by GTE Product Corporation, Danvers, Mass. Such lamps are manufactured in different varieties (e.g., 9 and 13 watt varieties). The lamp generally includes a sealed envelope 20 of light-transmitting vitreous material, such as soda-lime or lead glass and contains an ionizable medium including a quantity of mercury and an inert starting gas at low pressure, for example, in the order of 1–5 mm of mercury. An electrode is located within respective end portions of the envelope. A lamp base 22 having pin terminals (not shown) which mate with a plug-in socket in adapter 14 contains a glow discharge starter and radio frequency suppressing capacitor.

The adapter 14 includes a housing 26 having an upper surface 28. The housing 26 is formed from an insulative material and includes a pair of outwardly protruding lugs 24, 30. An incandescent lamp base 32 is provided at one end of the adapter. Incorporated within the adapter housing is a ballast (not shown) which is electrically coupled to the adapter base 32 and the fluorescent lamp 12.

Figure 2:
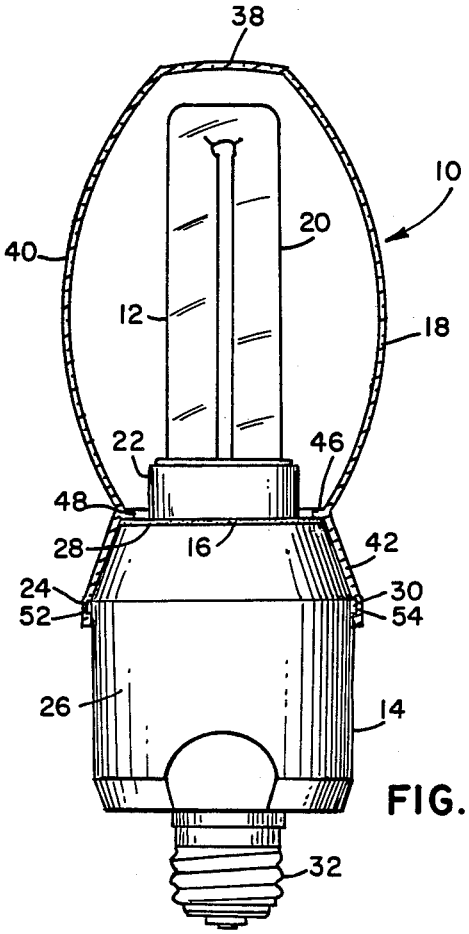
FIG. 2 is a front elevational view of the fluorescent lamp unit with the detachable jacket member illustrated in cross-section.
Figure 3:
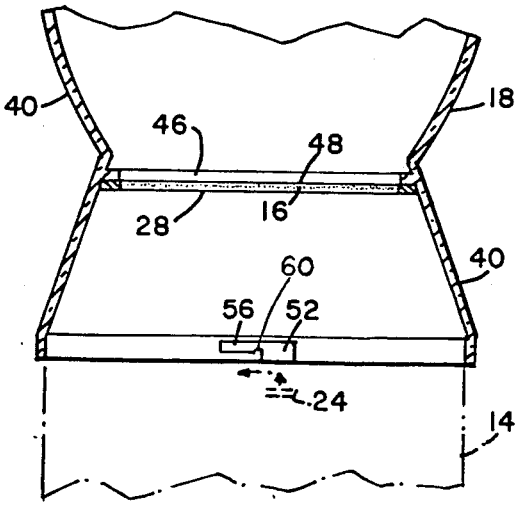
FIG. 3 is an exploded, cross-sectional, partial view of one embodiment of the compressible gasket member with the detachable jacket member and the adapter illustrated in phantom.
Figure 4:
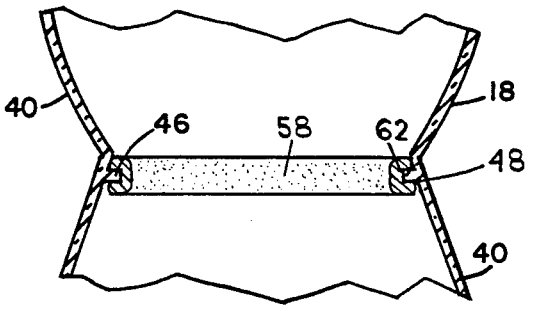
FIG. 4 is an exploded, cross-sectional, partial view of the detachable jacket member with another embodiment of the compressible gasket member illustrating the circumferential channel formed therein which receives the ledge in the jacket member.

A compressible annular-shaped gasket member 16 made of a resilient material, such as silicon or chloroprene, is positioned on the upper surface 28 of the adapter housing 26 as illustrated in FIGS. 2 and 3. Silicon is preferred since chloroprene may outgas at certain operating temperatures. In a preferred embodiment as best illustrated in FIG. 4, gasket member 58 is first secured to ledge 46 on jacket member 18 by means of a circumferential channel 62 formed in gasket member 46 which is adapted to receive ledge 46 in jacket member 18. Alternatively, a spring steel wavy washer or a phosphor bronze spring washer may be used for the gasket member.

A detachable jacket member 18 is preferable formed from a plastic diffusing material, such as polycarbonate, which is manufactured by General Electric Company under the trade name of Lexan. Alternatively, an acrylic material may be used. Jacket member 18 has an open end 36 and a closed end 38. Preferably, jacket member 18 comprises a dome portion 40 which encloses fluorescent lamp 12 and an integrally formed radially extending skirt portion 42 having a circular configuration which corresponds in size and configuration with the size and configuration of the upper portion of the adapter housing 26. When the lamp unit is assembled, as best illustrated in FIG. 2, the skirt prtion 42 of jacket member 18 extends over the upper portion of the adapter housing 26. The skirt portion of jacket member 18 provides stability to the assembled unit. Jacket member 18 further includes a ledge 46 integrally formed intermediate dome portion 40 and skirt portion 42. Ledge 46 protrudes inwardly from the inner surface of jacket member 18 and extends radially around jacket member 18. A lower bearing surface 48 on ledge 46 contacts the upper surface of compressible gasket member 16 to provide a weather-tight seal and to prevent undesirable movement of the jacket member on the adapter.

The open end 36 of jacket member 18 is provided with oppositely disposed L-shaped grooves 52, 54 each of which has an offset portion 56 which accommodates a respective lug 24, 30 to lock the jacket member to the adapter (as indicated by the arrows in FIG. 3). Preferably, L-shaped grooves 52, 54 further includes stop means formed therein for locking jacket member 18 in place by preventing rotational movement of the jacket member with respect to the adapter. Preferable, the stop means comprise a detent 60 formed adjacent offset portion 56 of grooves 52, 54.

The thickness of gasket member 16 is such that the gasket member requires compression before lugs 24, 30 can be rotated respectively past detents 60 and into offset portion 56 of grooves 52, 54 in jacket member 18. Accordingly, when the jacket member is locked on adapter 14, gasket member 16 aids in providing an effective seal for preventing dirt and moisture from entering the interior of the jacket member.

During assembly of the fluorescent lamp unit, the fluorescent lamp is electrically coupled to the adapter unit by plugging the lamp base into the adapter socket. Next, the annular gasket member is passed over the fluorescent lamp and axially positioned on the upper surface of the housing of the adapter. In the case of the gasket member with the circumferential channel, the gasket member is first positioned so that the ledge of the jacket member is enclosed within the channel of the gasket member. The jacket member is placed over the fluorescent lamp and radially orientated with respect to the adapter such that the oppositely disposed lugs on the adapter housing are in line with the opening of the grooves in the jacket member. Finally, the jacket member and adapter are forced together an amount sufficient to compress the gasket member to the point where the lugs on the adapter housing can be rotated past the detents and into the offset portion of the grooves in the jacket member. To remove the jacket member, the adapter and jacket member are again forced together an amount sufficient to compress the gasket member to the point at which the lugs can be rotated past the detents and into the openings of the grooves.

There has thus been shown and described an improved fluorescent lamp unit which comprises an adapter containing a ballast, a fluorescent lamp electrically coupled to the ballast, a compressible gasket member positioned on the upper surface of the adapter housing and a jacket member enclosing the fluorescent lamp. The jacket member is provided with an inwardly protruding ledge which extends radially around the interior of the jacket to provide a bearing surface for contacting the gasket member. The lower portion of the jacket member is provided with a pair of diametrically opposed grooves for engaging a pair of lugs formed in the housing of the adapter. The unit is thus adapted to be easily detached from the adapter upon failure of the fluorescent lamp. Moreover, a weather-tight seal is formed between the jacket member and the adapter housing to protect the lamp from dirt and moisture. The fluorescent lamp unit of the present invention has a more securely attached jacket member and does not allow any undesirable lateral, side-to-side movement of the jacket member with respect to the adapter.

While there have been shown and described what are at present considered to be the preferred embodiments of the invention, it will be apparent to those skilled in the art that various changes and modifications can be made herein without departing from the scope of the invention. The embodiments shown in the drawings and described in the specification are intended to best explain the principles of the invention and its practical application to hereby enable others in the art to best utilize the invention in various embodiments and with various modifications as are suited to the particular use contemplated.

What is claimed is:

1. A fluorescent lamp unit comprising:

a fluorescent lamp;

an adapter including a housing having an upper surface, a pair of lugs protruding from said housing, and a ballast contained within said housing electrically connected to said fluorescent lamp;

a compressible gasket member located on said upper surface of said adapter; and a detachable jacket member enclosing said fluorescent lamp and having an inner surface, said jacket member having a ledge protruding inwardly from said inner surface and extending radially around said jacket member; said ledge having a bearing surface for contacting said compressible gasket member, said jacket member further including a pair of diametrically opposed grooves formed in the inner surface of said jacket member and positioned to engage with said pair of lugs on said housing of said adapter.

2. The fluorescent lamp unit of claim 1 wherein said detachable jacket member includes a dome portion and skirt portion.

3. The fluorescent lamp unit of claim 2 wherein skirt portion extends over a portion of said housing of said adapter.

4. The fluorescent lamp unit of claim 2 wherein said grooves are formed in said skirt portion of said detachable jacket member.

5. The fluorescent lamp unit of claim 1 wherein each of said diametrically opposed grooves includes an offset portion.

6. The fluorescent lamp unit of claim 5 wherein said pair of diametrically opposed grooves each includes stop means formed therein for locking said jacket member in place by preventing rotational movement of said jacket member with respect to the adapter.

7. The fluorescent lamp unit of claim 6 wherein said stop means includes a detent formed adjacent said offset portion of said groove.

8. The fluorescent lamp unit of claim 1 wherein said compressible gasket member is silicon.

* * * * *